US007694352B2

(12) United States Patent
Kogawa et al.

(10) Patent No.: US 7,694,352 B2
(45) Date of Patent: Apr. 13, 2010

(54) GLOVE

(75) Inventors: Daisuke Kogawa, Osaka (JP); Kazuhiro Kume, Osaka (JP); Hiroshi Nagao, Osaka (JP)

(73) Assignee: Mizuno Corporation, Osaka (JP)

( * ) Notice: Subject to any disclaimer, the term of this patent is extended or adjusted under 35 U.S.C. 154(b) by 347 days.

(21) Appl. No.: 11/810,843

(22) Filed: Jun. 7, 2007

(65) Prior Publication Data

US 2008/0000009 A1 Jan. 3, 2008

(30) Foreign Application Priority Data

Jun. 9, 2006 (JP) ..... 2006-161620

(51) Int. Cl.
*A41D 19/00* (2006.01)

(52) U.S. Cl. ..... 2/161.1; 2/161.2; 2/159

(58) Field of Classification Search ..... 2/16, 2/159, 161.1, 161.2, 161.5, 161.6, 163; 66/174
See application file for complete search history.

(56) References Cited

U.S. PATENT DOCUMENTS

| | | | | |
|---|---|---|---|---|
| 2,707,283 | A * | 5/1955 | Silver et al. | 2/159 |
| 3,175,226 | A * | 3/1965 | Weinberg | 2/159 |
| 4,051,552 | A | 10/1977 | Widdemer | |
| 5,590,421 | A | 1/1997 | Craner | |
| 6,260,203 | B1 * | 7/2001 | Battle | 2/161.6 |
| 6,405,380 | B1 * | 6/2002 | Kuroda et al. | 2/161.1 |
| 6,415,445 | B1 * | 7/2002 | Nishijima et al. | 2/161.4 |
| 6,427,247 | B1 * | 8/2002 | Suk | 2/161.2 |
| 6,862,744 | B2 * | 3/2005 | Kuroda et al. | 2/161.1 |
| 7,213,419 | B2 * | 5/2007 | Hardee et al. | 66/174 |
| 2002/0042940 | A1 * | 4/2002 | Kuroda et al. | 2/161.1 |
| 2002/0152536 | A1 * | 10/2002 | Kuroda et al. | 2/161.1 |
| 2008/0000009 | A1 * | 1/2008 | Nagao et al. | 2/159 |
| 2008/0034468 | A1 * | 2/2008 | Kleinert | 2/159 |
| 2008/0078011 | A1 * | 4/2008 | Kleinert | 2/161.1 |

FOREIGN PATENT DOCUMENTS

| | | |
|---|---|---|
| JP | 4-136265 | 12/1992 |
| JP | 3031396 U | 9/1996 |

* cited by examiner

*Primary Examiner*—Gary L Welch
*Assistant Examiner*—Sally C Cline
(74) *Attorney, Agent, or Firm*—Hamre, Schumann, Mueller & Larson, P.C.

(57) ABSTRACT

In a glove having finger covering parts, a finger covering part corresponding to at least one finger selected from the third finger (middle finger), the fourth finger (ring finger), and the fifth finger (little finger) is configured by arranging protective members (2*a* to 2*e*) on anterior and posterior sides of the same, and arranging stretchable members (4*a* to 6*a*) on both lateral sides of the same. An inner perimeter of each finger covering part is substantially equal to an outer perimeter of the finger corresponding thereto. The stretchable members on the lateral sides of each finger have stretching forces such that a stretching force of the stretchable member on the lateral side on the first finger (thumb) side is higher than a stretching force of the stretchable member on the other lateral side on the fifth finger (little finger) side. When the glove is bent from an opened state to a gripping state, the finger covering part is bent with a twist at a gripping angle toward the first finger (thumb) side. Thus, a glove is provided that is capable of following changes in shape caused by a gripping action of a hand, providing both of the feeling of fitting and the feeling of support, and having a high-level protection function and a high-level of mobility function.

14 Claims, 9 Drawing Sheets

GLOVE

BACKGROUND OF THE INVENTION

1. Field of the Invention

The present invention relates to a glove suitable principally for sports such as golf, baseball, and the like.

2. Description of Related Art

In a sport such as golf, baseball, or the like that involves the gripping of a club or a bat, gloves are used principally for protecting the hands. When a hand assumes a state of gripping a club or a bat from an opened state, the shape of the hand changes significantly. Particularly, the back of the hand has significant changes in shape in the vicinities of the proximal phalanxes and the middle phalanxes. Therefore, if gloves are formed with a non-stretchable material such as leather, the glove is too stiff to provide a feeling of fitting, and the feeling when it is put on is impaired also. In contrast, in the case where gloves are formed exclusively with a mesh material or a stretchable material, a feeling of looseness is provided when it is put on, though good stretchability is obtained. Regarding the middle finger, the ring finger, and the little finger, it has been found that the axes of joints thereof are twisted in an action of gripping something, thereby causing a displacement between the glove and the hand. This causes seam lines to be shifted to between a gripped thing and the hand, and as a result discomfort is caused.

To solve these problems, a glove has been proposed in which a stretchable member is arranged in a gusset portion (lateral portion) on the thumb side of each finger covering part so as to eliminate the twisting upon gripping (Patent Document 1). This proposal eliminates the twisting by using a stretchable fabric on one side (on the thumb side) of each finger covering part, but another problem arises in that the finger covering parts do not fit to the fingers, while the control of a twist angle and the magnitude of the same is difficult.

As another proposal, a glove has been proposed in which each gore is cut in a shape bent toward the palm side so that the finger covering part is bent toward the palm side preliminarily (Patent Document 2). This proposal has a problem that the glove fits to the hand when the fingers are bent in a gripping state, but does not fit when the fingers are stretched out, and further, the glove is not capable of following a twist.

As described above, in the prior art, there is a problem that a glove cannot follow complicated three-dimensional changes in the shape of the hand and fingers.

[Patent Document 1] JP 3031396 U

[Patent Document 2] JP 4(1992)-136265 A

SUMMARY OF THE INVENTION

To solve the problems of the prior art, the present invention provides a glove that is capable of following changes in shape of a hand caused by a gripping action, providing both of the feeling of fitting and the feeling of being supported (hereinafter referred to as feeling of support), and having a high-level protection function and a high-level mobility function.

A glove of the present invention is a glove having finger covering parts, wherein a finger covering part corresponding to at least one finger selected from the third finger (middle finger), the fourth finger (ring finger), and the fifth finger (little finger) is configured by arranging protective members on anterior and posterior sides of the same, and arranging stretchable members on both lateral sides of the same; an inner perimeter of each finger covering part is substantially equal to an outer perimeter of the finger corresponding thereto; straining properties of the stretchable members on the lateral sides of the fingers are set so that, regarding each of these fingers a straining property on the first finger (thumb) side is higher than a straining property on the fifth finger (little finger) side; and when the glove is bent from an opened state to a gripping state, the finger covering part is bent with a twist at a gripping angle toward the first finger (thumb) side.

DETAILED DESCRIPTION OF THE INVENTION

The glove of the present invention is capable of following changes in the shape of the hand caused by a gripping action, providing both of the feeling of fitting and the feeling of support, and having a high-level protection function and a high-level of mobility function. More specifically, when the glove is bent from an opened state to a gripping state, junction portions between anterior protective members and stretchable members on the thumb side are not shifted toward a palm side, and the junction portions are fixed on lateral sides of the fingers. In other words, the finger covering parts are twisted at gripping angles toward the first finger (thumb) side. This causes the glove to follow changes in shape caused by a gripping action of the hand. Besides, since protective members are arranged on the anterior and posterior sides of the finger, a force of the hand is conveyed easily to the glove, and this allows the glove to provide the feeling of support. As a result, this makes it possible to provide the glove having a high-level protection function and a high-level mobility function.

Figure 8:
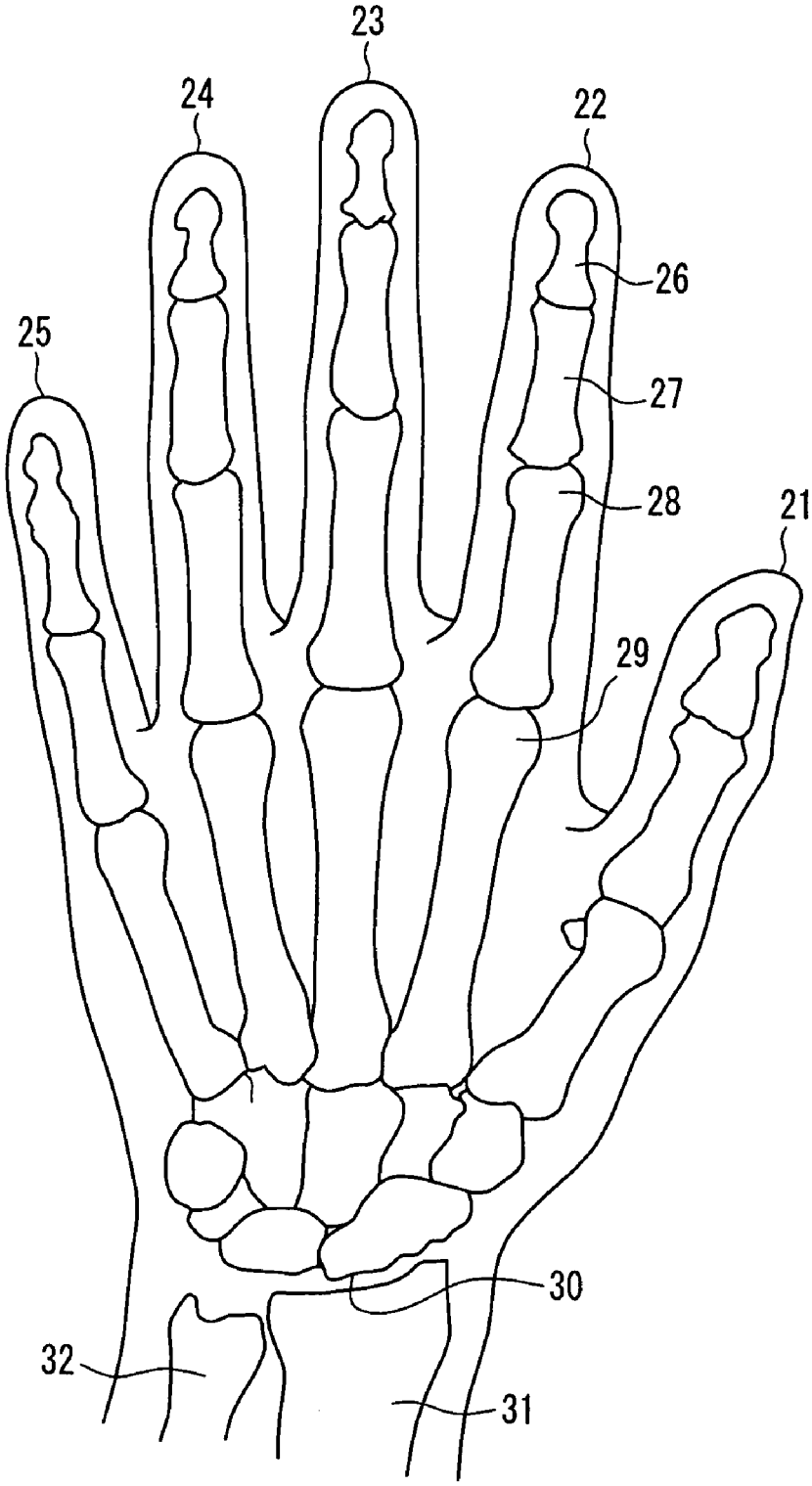
FIG. 8 explains the bones of the hand and fingers.

For the description of the present invention, first of all, bones of the hand and fingers are described. FIG. 8 is a perspective view of the left hand of a human viewed from the side of the back of the hand. The hand and fingers are composed of the first finger (thumb) 21, the second finger (forefinger) 22, the third finger (middle finger) 23, the fourth finger (ring finger) 24, and the fifth finger (little finger) 25. Each finger, for example, the second finger forefinger) 22, is composed of a distal phalanx 26, a middle phalanx 27, and a proximal phalanx 28 from the distal side, and is connected to a metacarpal bone 29. The metacarpal bone 29 is connected to several small bones, which are connected to a carpal 30. A radius 31 and a ulna 32, which are bones of the arm, are present facing the carpal 30. Normally, the "wrist" refers to an area extending from the vicinity of the carpal 30 to the vicinity of the ends of the radius 31 and the ulna 32.

The inventors of the present invention made various analyses by focusing attention on motions of finger joints in a gripping action in sports such as baseball and golf. The third finger (middle finger), the fourth finger (ring finger), and the fifth finger (little finger) in particular, when assuming a gripping state from a opened state, do not exhibit a bending motion like that of a simple hinge structure, but exhibit a bending motion with rotation axes themselves being twisted. Thus, these fingers bend with a twist to the thumb side. For example, with the palm opened state being a reference state, average twist angles of the third finger (middle finger), the fourth finger (ring finger), and the fifth finger (little finger) in an action for gripping a bat were 3.2°, 6.9°, and 10.7°, respectively. In this case, the angle refers to an angle of twist, which is an angle between a direction of a longitudinal axis of a distal phalanx in a palm opened state and a direction of the same with a twist in a gripping state, which is determined by projecting the directions onto a plane obtained by extending the palm along the proximal phalanxes as a reference. To cause the glove to follow such motions of the fingers, finger covering parts are configured by arranging protective members on anterior and posterior sides of the fingers, and stretchable members on both lateral sides of at least the third finger (middle finger), the fourth finger (ring finger), and the fifth finger (little finger). As an example, by forming the protective members and the stretchable members so that the protective members have widths equal to or smaller than widths of corresponding fingers, respectively, and the stretchable members have widths equal to or smaller than thicknesses of corresponding fingers, respectively, an inner perimeter of each finger covering part is set to be substantially equal to an outer perimeter of the finger. Besides, by setting straining properties of the stretchable members on the lateral sides of the fingers so that, regarding each of these fingers a straining property on the first finger (thumb) side is higher than a straining property on the fifth finger (little finger) side, the glove is configured so that when the glove is bent from an opened state to a gripping state, the foregoing finger covering parts are twisted at gripping angles toward the first finger (thumb) side, while remaining fitted to the fingers, respectively.

In the present invention, an inner perimeter of each finger covering part is substantially equal to an outer perimeter of the finger corresponding thereto. Here, the phrase "substantially equal" means that an inner perimeter of each finger covering part is in a range of ±10% of an outer perimeter of the finger corresponding thereto.

An example of the present invention is described below in more detail with reference to the drawings.

Figure 1:
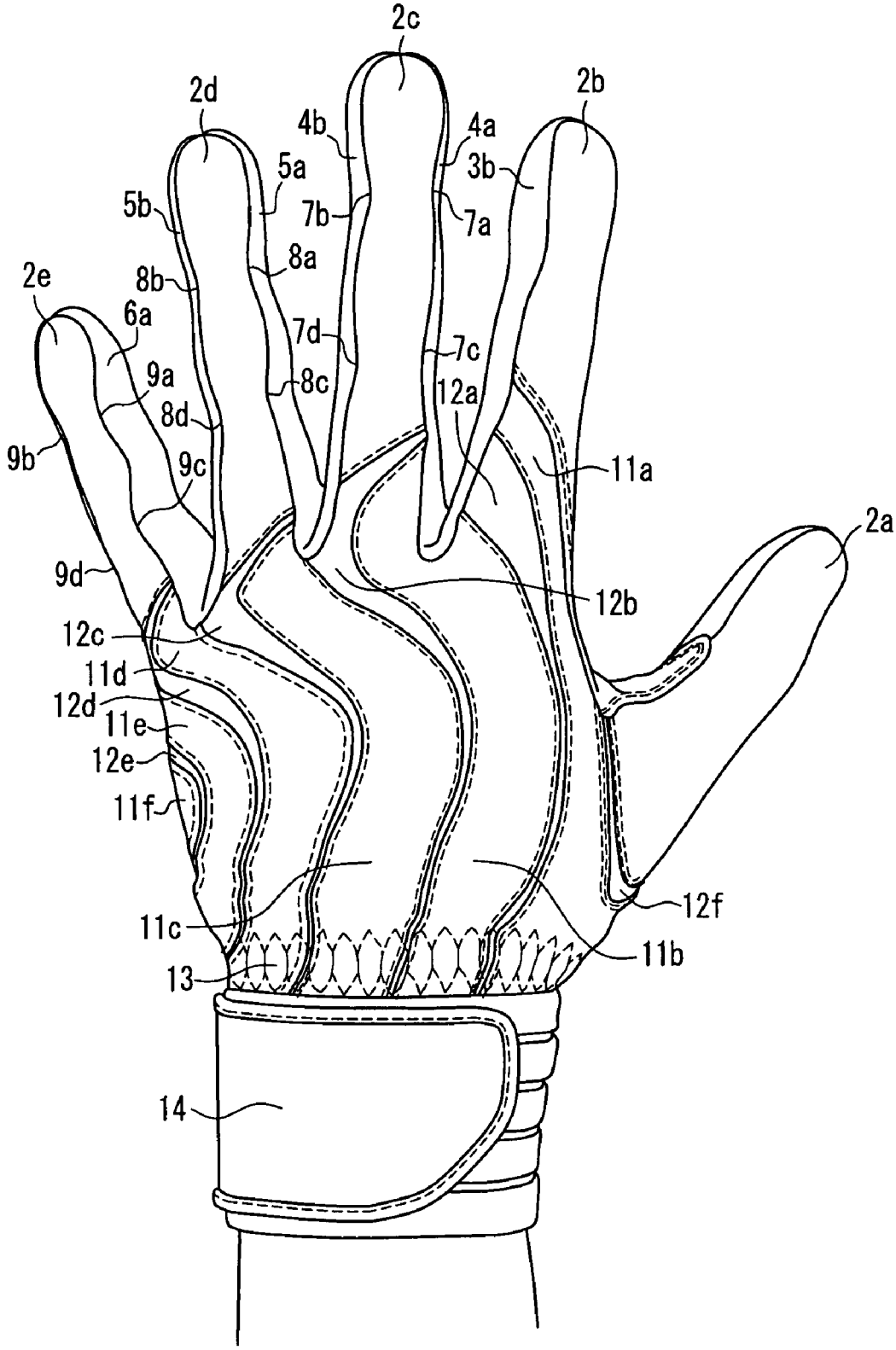
FIG. 1 is a rear view of a glove according to an example of the present invention.
Figure 2:
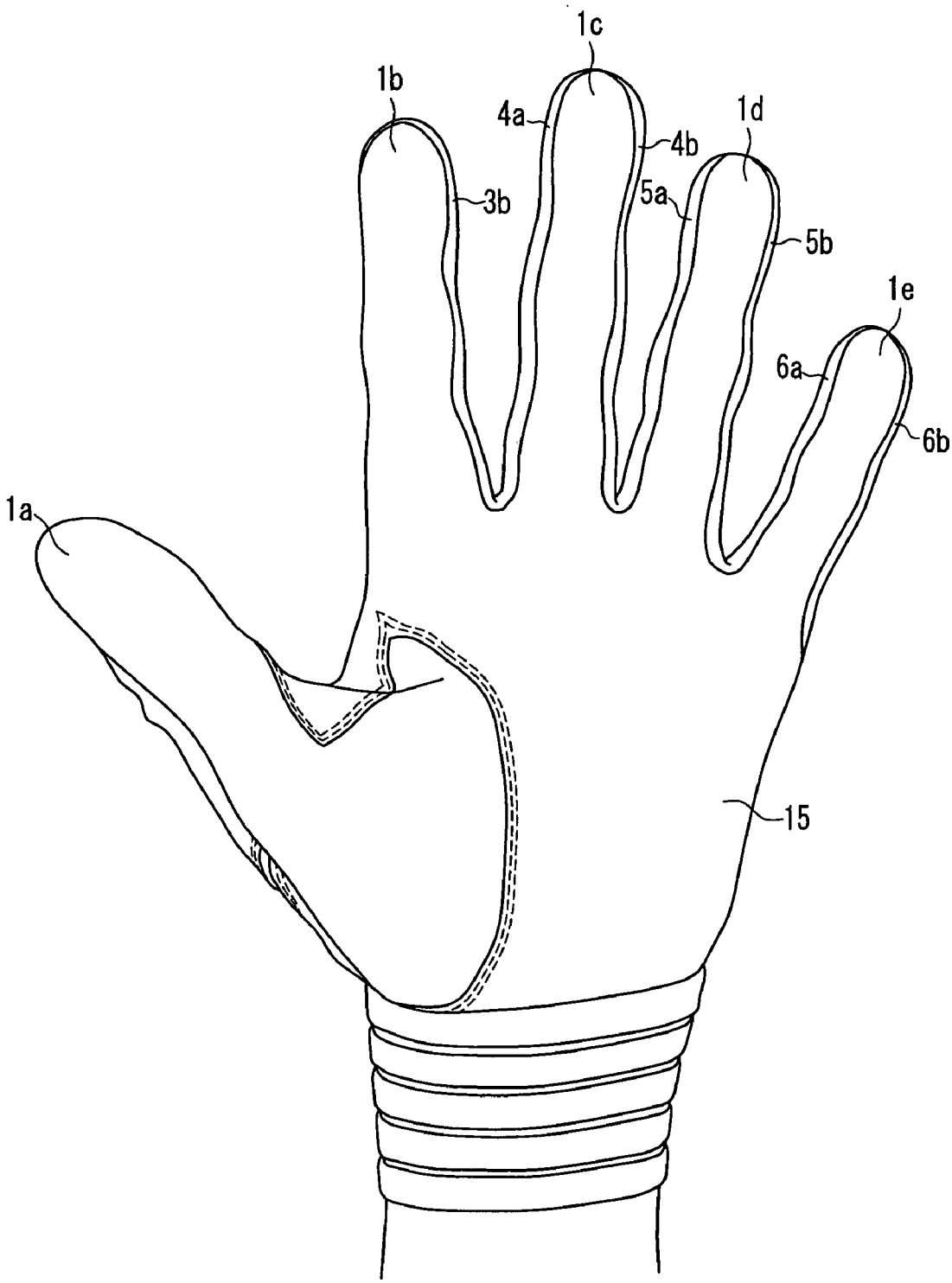
FIG. 2 is a front view of the glove.
Figure 3:
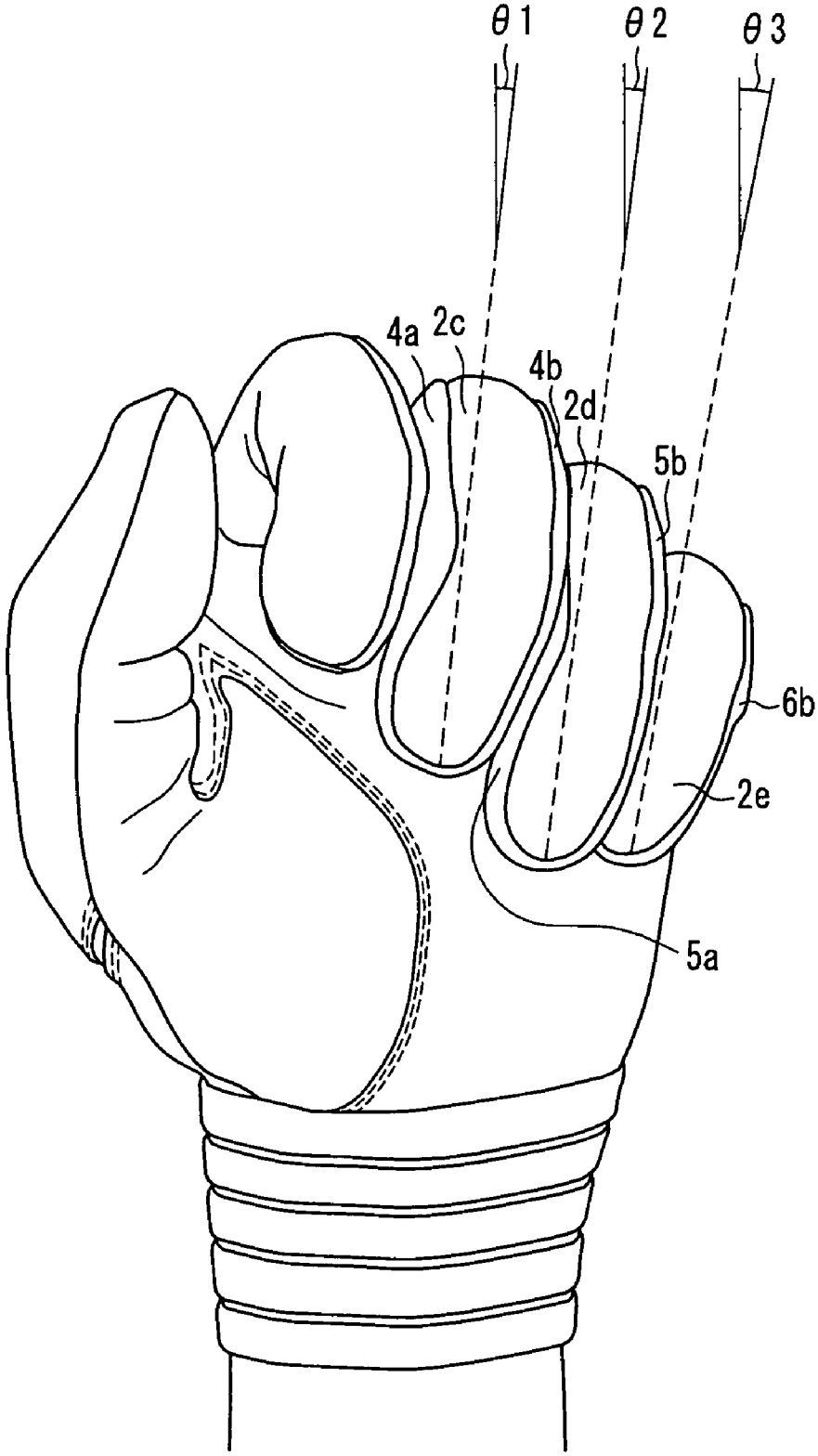
FIG. 3 is a front view of the glove in a gripping state when it is put on the hand.
Figure 4A:
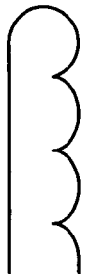
FIGS. 4A to 4K are plan views showing cut patterns of a protective member according to an example of the present invention.
Figure 4B:
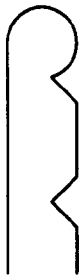
Figure 4C:
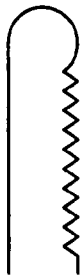
Figure 4D:
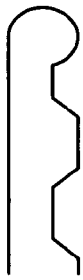
Figure 4E:
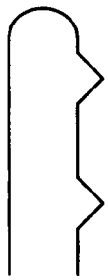
Figure 4F:
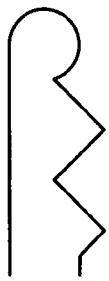
Figure 4G:
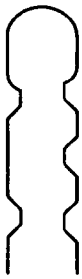
Figure 4H:
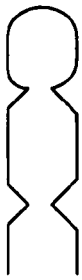
Figure 4I:
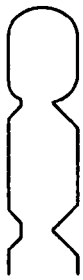
Figure 4J:
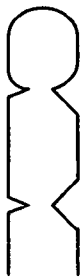
Figure 4K:
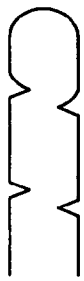

FIGS. 1 to 3 show an example of a glove for use in baseball. FIG. 1 is a rear view of a glove of the present invention, FIG. 2 is a front view of the foregoing glove, and FIG. 3 is a front view of the glove when the glove is put on a hand and the hand assumes a gripping state. This glove is configured so that each finger covering part is formed by arranging protective members (anterior members 1*a* to 1*e*, posterior members 2*a* to 2*e*) made of a natural leather, a synthetic leather, or an artificial leather on the anterior side and the posterior side of each finger, and arranging stretchable members (4*a*, 4*b*, 5*a*, 5*b*, 6*a*, and 6*b*) on both of the lateral sides of at least one of the third finger (middle finger), the fourth finger (ring finger), and the fifth finger (little finger).

In the present invention, to set straining properties of the stretchable members on the lateral sides of the third to fifth fingers so that, regarding each of these fingers, a straining property on the first finger (thumb) side is higher than a straining property on the fifth finger (little finger) side, the following methods, for example, can be used.

(1) By using fabrics having different stretching forces, the straining property of the stretchable member (4*a*, 5*a*, 6*a*) on the first finger (thumb) side of each finger is set higher than the straining property of the stretchable member (4*b*, 5*b*, 6*b*) on the fifth finger (little finger) side (4*b*, 5*b*, 6*b*) of the same finger.

(2) In each finger, the stretchable member is junctioned by increasing the tension on the first finger (thumb) side relative to the tension on the fifth finger (little finger) side. In this case, the stretchable members for each finger may be formed with fabrics having different stretching forces, respectively, or may be formed with fabrics having the same stretching force.

In the case of (2) above, more specifically, it is preferable that when the stretchable members and the protective members are integrated by sewing or bonding, a difference between a length of a junction allowance (A1) of the stretchable member on the first finger (thumb) side and a length of a junction allowance (B1) of the protective member corresponding to the junction allowance (A1) is set greater than a difference between a length of a junction allowance (A2) of the stretchable member on the fifth finger (little finger) side and a junction allowance (B2) of the protective member corresponding to the junction allowance (A2). Further preferably, one or a plurality of narrowed portions are formed in either the junction allowance (B1) on the first finger (thumb) side of the protective member, or the junction allowance (B1) on the first finger (thumb) side and the junction allowance (B2) on the fifth finger (little finger) side, so that the junction allowance (B1) on the first finger (thumb) side is longer than the junction allowance (B2) on the fifth finger (little finger) side. In the above-described case, on both of the thumb side and the little finger side, a greater difference between the pre-junction length of the stretchable member and the pre-junction length of the protective member ("difference" herein implies how much shorter the stretchable member is than the protective member), the stretchable member is more tensioned upon junction. This results in a higher straining property, and makes it possible to generate a twist toward the thumb side. The following description is on the premise that the stretchable members are tensioned upon junction, and such a difference between the junction lengths of the stretchable member and the protective member is referred to simply as "junction distance" in some cases.

The stretchable members are formed with a knitted fabric or a woven fabric, or alternatively, a natural leather, a synthetic leather, or an artificial leather relatively more stretchable than the protective members. Preferably, the stretching force is set such that an extension ratio of a 5 cm-wide piece of the stretchable member under a load of 4.9 N (500 gf), measured according to JIS 1096, is in a range of 5 to 150% in at least one selected from the warp and weft directions. With the stretching force in this range, the stretchable members allow the glove to follow motions of the hand and fingers and provide a high-level feeling of fitting. In the case where the width is less than 5 cm, the load is decreased proportionally. For example, in the case where the width is 1 cm, the load is decreased to ⅕. The stretchable members preferably have a density (weight per unit area) in a range of 100 to 400 g/m$^2$. With the density in this range, weight is not felt, while a high-level feeling of fitting is provided.

Preferably, the stretching forces of the stretchable members are set so that the stretching force of the stretchable member (4*a*, 5*a*, 6*a*) on the lateral side of each finger on the first finger (thumb) side is 4 to 20% higher than that of the stretchable member (4*b*, 5*b*, 6*b*) on the lateral side of each finger on the fifth finger (little finger) side.

The stretchable members (3*b*, 4*a*, 4*b*, 5*a*, 5*b*, 6*a*, and 6*b*) and the protective members (anterior members 1*a* to 1*e*, posterior members 2*a* to 2*e*) are integrated with each other by sewing or bonding, and in the case where junction distances on the thumb side for the third to fifth fingers are set greater than junction distances on the little finger side, it is preferable that the junction distance of the stretchable and protective members on the thumb side is 4 to 8% greater than that on the little finger side for the third finger (middle finger), 10 to 14% greater for the fourth finger (ring finger), and 15 to 19% greater for the fifth finger (little finger). This configuration also makes it possible to achieve a twist toward the thumb side. In this case, the stretchable members (4*a*, 5*a*, 6*a*) on the thumb side and the stretchable members (4*b*, 5*b*, 6*b*) on the little finger side can be formed with materials having the same stretching force, and the straining properties are measured by sensory testing with the glove being put on a hand. More specifically, a comparative glove is prepared in which the stretching force (4*a*, 5*a*, 6*a*) on the lateral side on the thumb side for each finger is set 4 to 20% higher than the stretching force (4*b*, 5*b*, 6*b*) on the lateral side on the little finger side for the same finger and the junction distances on the thumb side and the little finger side are set equal as described above, and it is determined by sensory testing by wearing the gloves whether or not the glove in the above-described case exhibits identical straining properties to those of the comparative glove. The measurement is performed by sensory testing also in the case where the stretchable member is junctioned by increasing the tension on the first finger (thumb) side relative to that on the fifth finger (little finger) side. In FIG. 1, 11*a* to 11*d* denote separate rows of protective members, 12*a* to 12*f* denote stretchable members, 13 denotes an elasticized constriction part, and 14 denotes a strap for protecting the wrist.

Figures 5A, 5B:
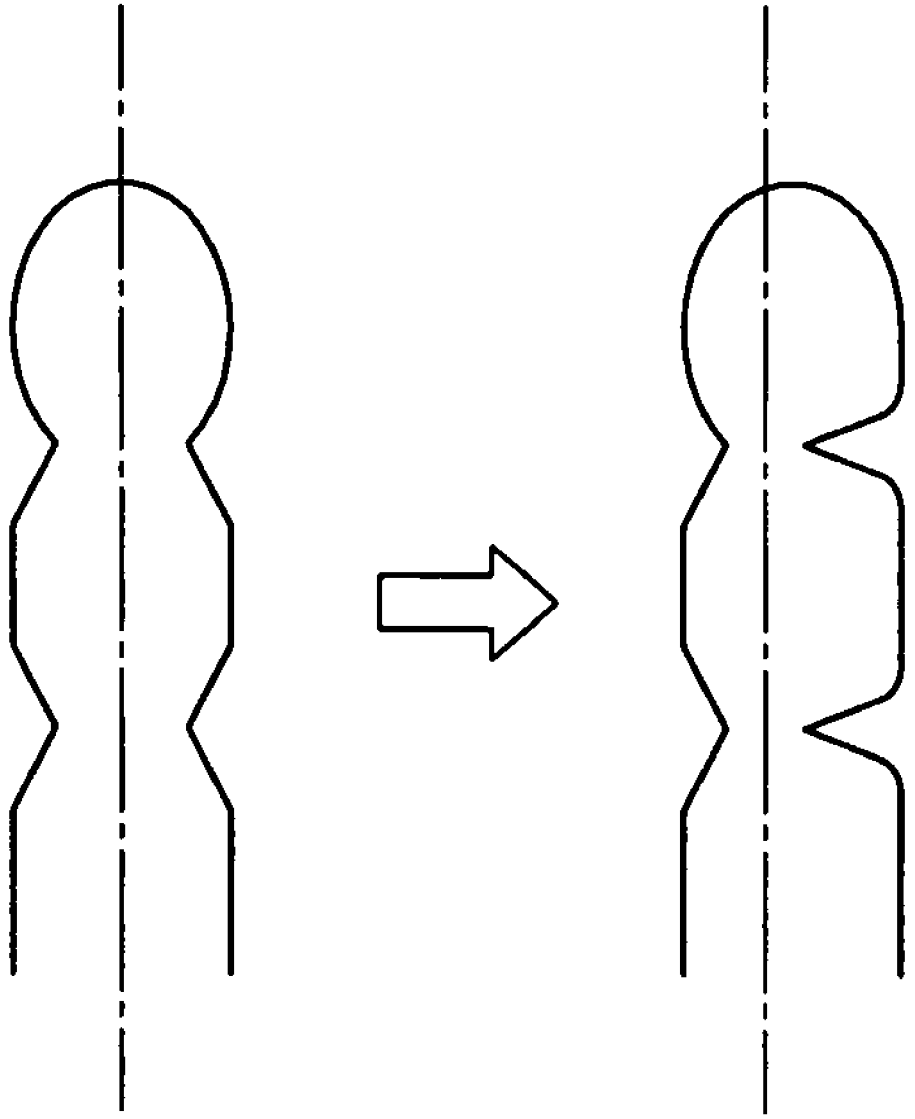
FIGS. 5A and 5B are plan views showing cut patterns of a protective member according to another example of the present invention.

To set the junction distances for the stretchable and protective members longer, in the case of a glove for the left hand, as shown in FIGS. 4A to 4K, each protection member to be provided on the side of the back of the hand is configured so as to have a longer cut edge on the right side, and is arranged so that the longer cut edge thereof is oriented toward the thumb. Alternatively, as shown in FIG. 5B, each protection member is configured so that the center line thereof in the longitudinal direction of the finger is shifted toward a shorter cut edge thereof. This also makes it possible to achieve a twist toward the thumb side.

It is preferable that the protective member is formed with a natural leather, a synthetic leather, or an artificial leather. This allows the glove to maintain a protection function for protecting the fingers and a mobility function at high levels. Here, the "natural leather" refers to leather of an animal such as cowskin, pigskin, sheepskin, buckskin, or the like. The "synthetic leather" refers to a woven or knitted fabric made of nylon or the like whose surface is coated with a synthetic resin such as a polyurethane resin or a vinyl chloride resin. The "artificial leather" refers to a non-woven fabric as a base whose surface is coated with a synthetic resin such as a polyurethane resin, a polyamino acid resin, a nylon resin, or a vinyl chloride resin, and is subjected to surface treatment, for example, so as to be sueded.

The stretching force of the stretchable members on the first finger (thumb) side may be set higher than the stretching force of the stretchable members on the fifth finger (little finger) side. This makes it possible to set the stretching force on the first finger (thumb) side higher than the stretching force on the fifth finger (little finger) side regarding the lateral sides of each finger.

It is preferable that the stretching force on the first finger (thumb) side is 4 to 8% greater than that on the fifth finger (little finger) side for the third finger (middle finger), 10 to 14% greater for the fourth finger (ring finger), and 15 to 19% greater for the fifth finger (little finger). More preferably, the stretching force on the first finger (thumb) side is 5 to 7% greater than the stretching force on the fifth finger (little finger) side for the third finger (middle finger), 11 to 13% greater for the fourth finger (ring finger), and 16 to 17% greater for the fifth finger (little finger). This configuration allows the glove to follow twisting motions of the fingers.

Further, as shown in FIG. 1, the stretchable members and the protective members for the third finger (middle finger), the fourth finger (ring finger), and the fifth finger (little finger) may be configured to have narrowed portions (7*a* to 7*d*, 8*a* to 8*d*, 9*a* to 9*d*) in areas thereof covering the middle phalanxes and the distal phalanxes of these fingers, so that the depths of the recesses of the narrowed portions (7*a*, 7*c*, 8*a*, 8*c*, 9*a*, 9*c*) on the first finger (thumb) side may be increased. This makes it possible to set the straining property on the first finger (thumb) side higher than the straining property of the fifth finger (little finger) side regarding the lateral sides of each finger. Here, by shifting the narrowed portions on the side of the back of the band toward the finger tip side, while shifting the narrowed portions on the palm side toward the finger base side, the glove is allowed further to follow gripping motions of the fingers.

Further, it is preferable that a twist angle when the glove is bent from an opened state to a gripping state is, in a direction toward the first finger (thumb) side, in a range of 2° to 4.5° for the third finger (middle finger), in a range of 5.5° to 8.5° for the fourth finger (ring finger), and in a rang of 9° to 12° for the fifth finger (little finger). More preferably, the foregoing twist angle is in a range of 2.7° to 3.7° for the third finger (middle finger), in a range of 6.4° to 7.4° for the fourth finger (ring finger), and in a range of 10.2° to 11.3° for the fifth finger (little finger).

Figure 6A:
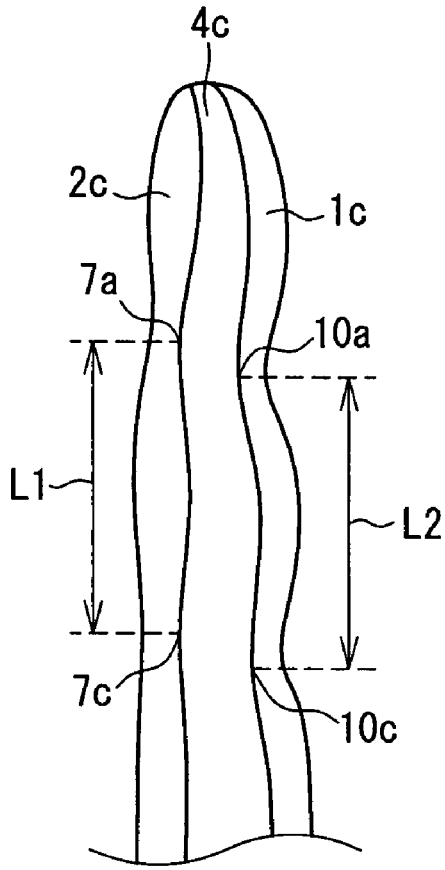
FIGS. 6A and 6B are side views showing a gripping motion of the middle finger when a glove according to an example of the present invention is put on the hand.
Figure 6B:
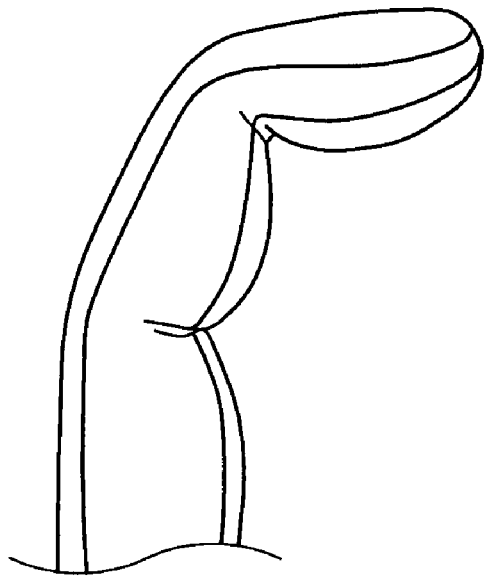
Figure 7A:
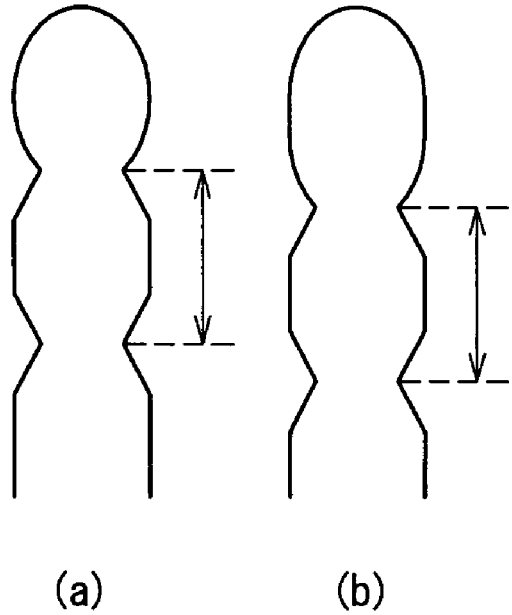
FIGS. 7A and 7B are developed views of a posterior member (a) and an anterior member (b) as protective members according to an example of the present invention.
Figure 7B:
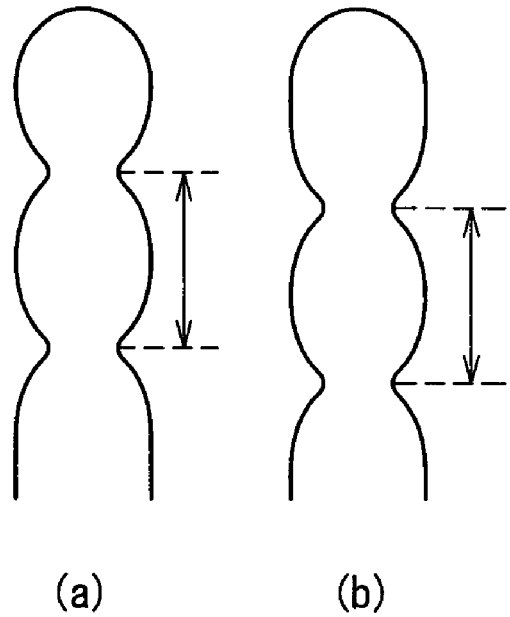

Next, FIGS. 6A to 6B are side views illustrating motions of the fingers in a gripping action when the glove is put on the hand, by referring to the case of the middle finger as an example. As shown in FIG. 6A, as compared with positions of the narrowed portions 7*a* and 7*c* of the posterior member 2*c* as the protective member on the side of the back of the hand, the positions of the narrowed portions 10*a* and 10*c* of the anterior member 1*a* are lowered by 0.5 to 3 mm. This allows the narrowed portions to follow motions of the finger in a gripping action as shown in FIG. 6B, thereby improving the feeling of fitting. L1 and L2 denote distances between the narrowed portions. FIGS. 7A to 7B are developed views of the posterior member (a) and the anterior member (b) as protective members, which show that positions of narrowed portions of the anterior member are lowered.

EXAMPLES

The present invention is described more specifically, with reference to Examples.

Example 1

A glove for use in baseball was produced as shown in FIGS. 1 to 3. The following members were used. It should be noted that no narrowed portions were formed in the protective members on the finger covering parts.

(1) Protective member (1*b* to 1*e*) (integrally provided) extended from a palm 15 to an anterior side of each finger, and protective member (1*a*) on an anterior side of the thumb:

natural cowskin with a density of 297 g/m$^2$.

(2) Protective members on the back of the hand and the posterior side of each finger:

natural cowskin with a density of 297 g/m$^2$.

(3) Stretchable members on lateral sides of each finger:

two-way (stretchable in the warp and weft directions) knitted fabrics with a density of 215 g/m$^2$ made of nylon and polyurethane fibers; the following types of fabrics with the following extension ratios of 5 cm-wide pieces thereof under a load of 4.9 N (500 gf) were used:

on the lateral side on the thumb side of the middle finger: a fabric piece with an extension ratio of 75% in the warp direction and 70% in the weft direction was arranged so that the warp direction coincided with the lengthwise direction on the finger lateral side;

on the lateral side on the little finger side of the middle finger: a fabric piece with an extension ratio of 82% in the warp direction and 75% in the weft direction was arranged so that the warp direction coincided with the lengthwise direction on the finger lateral side;

on the lateral side on the thumb side of the ring finger: a fabric piece with an extension ratio of 72% in the warp direction and 67% in the weft direction was arranged so that the warp direction coincided with the lengthwise direction on the finger lateral side;

on the lateral side on the little finger side of the ring finger: a fabric piece with an extension ratio of 82% in the warp direction and 75% in the weft direction was arranged so that the warp direction coincided with the lengthwise direction on the finger lateral side;

on the lateral side on the thumb side of the little finger; a fabric piece with an extension ratio of 70% in the warp direction and 65% in the weft direction was arranged so that the warp direction coincided with the lengthwise direction on the finger lateral side; and on the lateral side of the palm and the little finger; a fabric piece with an extension ratio of 82% in the warp direction and 75% in the weft direction was arranged so that the warp direction coincided with the lengthwise direction of the finger lateral side.

(4) Inner perimeter of finger covering parts:

The inner perimeters of portions covering joints between the proximal phalanxes and the middle phalanxes of the fingers were set as follows so as to make the inner perimeters of the finger covering parts were substantially equal to outer perimeters of the fingers, respectively. The following values are equivalent to outer perimeters of the fingers of an average human:

thumb: 65 mm
forefinger: 55 mm
middle finger: 58 mm
ring finger: 55 mm
little finger: 50 mm (5) Stretchable member on the back of the hand:

a two-way knitted fabric made of nylon and polyurethane fibers with a density of 215 g/m$^2$ and an extension ratio of a 5 cm-wide piece thereof under a load of 4.9 N (500 gf) of 82% in the warp direction and 75% in the weft direction, arranged so that the weft direction coincided with the lengthwise direction of the back of the hand.

As a result, a glove was configured so that twist angles θ1, θ2, and θ3 for the middle finger, the ring finger, and the little finger as shown in FIG. 3 were about 2.3°, about 4.7°, and about 8.0°, respectively.

When a baseball bat was gripped with the glove thus configured being put on the hand, it was recognized that the finger covering parts for the respective fingers were twisted at gripping angles toward the first finger (thumb) side while being fitted to the fingers. Besides, it was recognized also that the glove followed changes in shape caused by a gripping action of the hand, provided the feeling of fitting and the feeling of support without shift of the protective members on the palm side (natural leather) to the left or right side and without shift of seam lines into between the hand and the bat, and exhibited a high-level protection function and a high-level mobility function.

Example 2

A glove for use in baseball was produced as shown in FIGS. 1 to 3. The following members were used.

(1) Protective member (1*b* to 1*e*) (integrally provided) extended from a palm 15 to an anterior side of each finger, and protective member (1*a*) on an anterior side of the thumb:

natural cowskin with a density of 297 g/m$^2$.

(2) Protective members on the back of the hand and the posterior side of each finger:

natural cowskin with a density of 297 g/m$^2$.

(3) Stretchable members on lateral sides of each finger:

a two-way knitted fabric made of nylon and polyurethane fibers with a density of 215 g/m$^2$ and an extension ratio of a 5 cm-wide piece thereof under a load of 4.9 N (500 gf) of 82% in the warp direction and 75% in the weft direction, arranged so that the warp direction coincided with the lengthwise direction of the lateral sides of the fingers.

(4) Inner perimeters of finger covering parts:

the inner perimeters of the finger covering parts were set identical to those of Example 1.

(5) Stretchable member on the back of the hand:

a two-way knitted fabric made of nylon and polyurethane fibers with a density of 215 g/m$^2$ and an extension ratio of a 5 cm-wide piece thereof under a load of 4.9 N (500 gf) of 82% in the warp direction and 75% in the weft direction, arranged so that the warp direction coincided with the lengthwise direction of the back of the hand.

The glove was sewn with narrowed portions being provided in the protective members for the fingers, as shown in FIGS. 1 and 2. Here, as shown in FIG. 6A, positions of the narrowed portions on the anterior sides of the fingers were lowered by 3 mm with respect to the narrowed portions on the posterior sides of the fingers, and L1 and L2 were set to 18 mm and 17 mm, respectively. Regarding the narrowing degrees of the narrowed portions, as shown in FIG. 1, the recesses on the thumb side were set greater while the recesses on the little finger side were set smaller. By so doing, as compared with junction distances in the case where cut edges are straight, the junction distances on the thumb side and on the little finger side increased by 12% and 5%, respectively. Since materials having the same stretching force were used for both the stretchable members on the lateral sides of the fingers on the thumb side and those on the little finger side, the tension on the materials on the thumb side was increased as compared with the tense on the little finger side upon junction, which resulted in a force being exerted on the thumb sides. Since this effect is increased as the fingers are bent, the glove was allowed to follow the twist of the fingers. It was recognized that the glove was formed so that the twist angles θ1, θ2, and θ3 for the middle finger, the ring finger, and the little finger as shown in FIG. 3 were about 2.5°, about 5.2°, and about 8.7°, respectively, the glove provided the feeling of fitting and the feeling of support without shift of seam lines to between the hand and the bat, and exhibited a high-level protection function and a high-level mobility function.

Example 3

Narrowed portions were provided in the protective members for the fingers as in Example 2, and the stretchable members on the thumb side and on the little finger side were formed with knitted fabrics having different stretching forces, respectively, as in Example 1. The other portions were formed in the same manner as that in Example 1.

As a result, a glove was formed so that twist angles θ1, θ2, and θ3 for the middle finger, the ring finger, and the little finger as shown in FIG. 3 were about 3.2°, about 6.9°, and about 10.7°, respectively.

When a baseball bat was gripped with the glove thus configured being put on the hand, it was recognized that the finger covering parts for the respective fingers were twisted at gripping angles toward the first finger (thumb) side while being fitted to the fingers. Besides, it was recognized also that the glove followed changes in shape caused by a gripping action of the hand, provided the feeling of fitting and the feeling of support without shift of the protective members on the palm side (natural leather) to the left or right side and without shift of seam lines into between the hand and the bat, and exhibited a high-level protection function and a high-level mobility function.

Comparative Example 1

Figure 9:
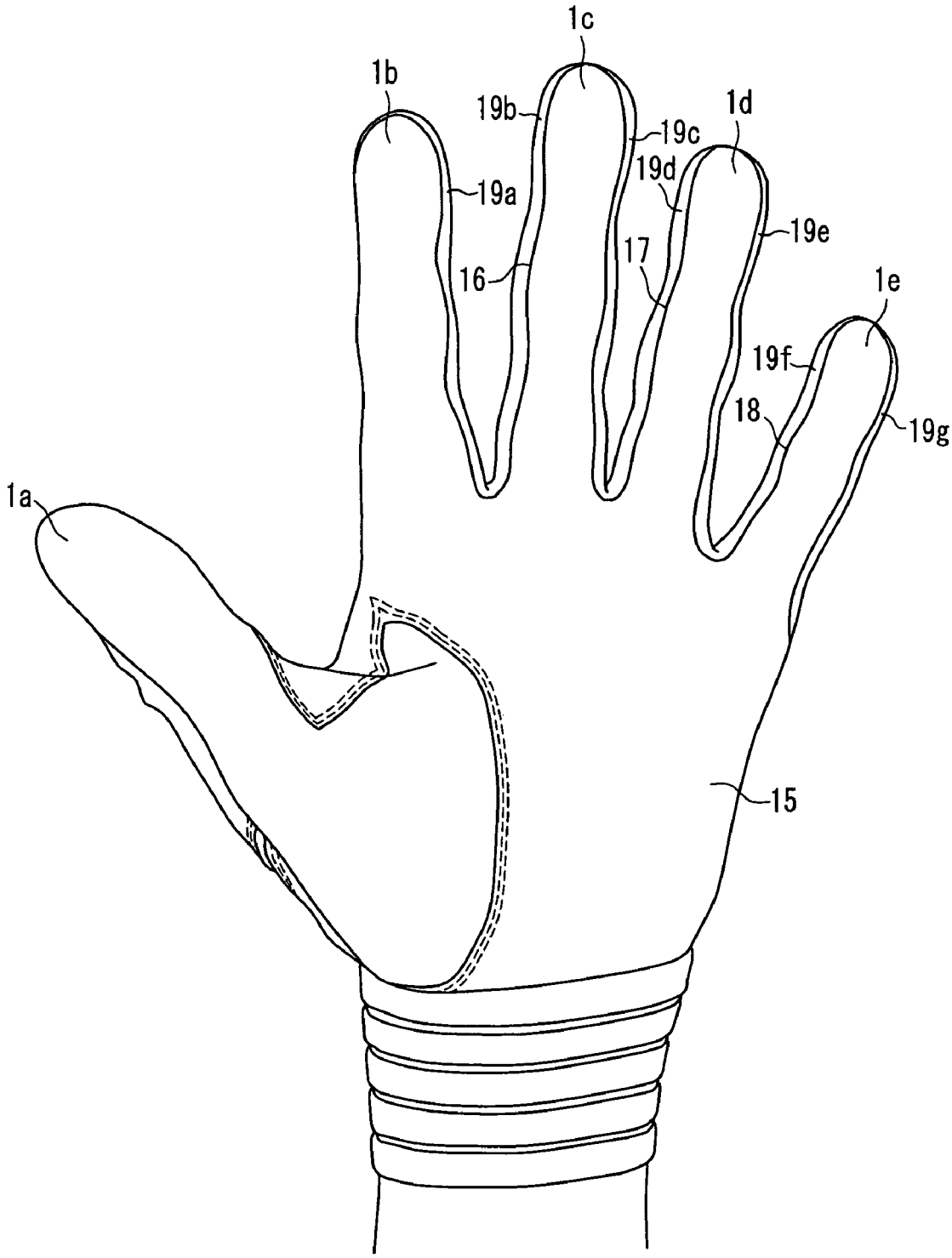
FIG. 9 is a front view of a glove of a comparative example.

FIG. 9 is a front view showing a glove according to Comparative Example 1. This glove was different from a glove of Example 1 in that on lateral sides of finger covering parts, protective members (19*a* to 19*g*), which were formed with the same material as that for the protective members on the anterior side, were provided integrally by sewing. When a baseball bat was gripped with the glove thus configured being put on the hand, it was recognized that seam lines 16, 17, and 18 between the protective members on the anterior side and the stretchable members on the lateral side on the thumb side for the middle finger, the ring finger, and the little finger, respectively, were shifted to between the fingers and the bat, thereby causing discomfort in the gripping state. In other words, the foregoing seam lines 16, 17, and 18 were shifted to between the bat and the middle finger, the ring finger, and the little finger. This phenomenon was caused as follows. Since the each finger is twisted at a gripping angle toward the first finger (thumb) side, whereas the glove is only bent toward the anterior side in a fixed state, the fingers and the finger covering parts were displaced from each other for the twist angle of the fingers.

INDUSTRIAL APPLICABILITY

The glove of the present invention can be used suitably in sports such as golf, baseball, tennis, badminton, squash racquets, ski, mountaineering, and walking, as well as in riding a motorbike, a bicycle, etc.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A glove having finger covering parts, wherein a finger covering part corresponding to at least one finger selected from a third finger (middle finger), a fourth finger (ring finger), and a fifth finger (little finger) is configured by arranging protective members on anterior and posterior sides of the selected finger, and arranging stretchable members on both lateral sides of the selected finger, an inner perimeter of each finger covering part is substantially equal to an outer perimeter of the finger corresponding thereto, straining properties of the stretchable members on the lateral sides of the fingers are set so that regarding each finger a straining property on a first finger (thumb) side is higher than a straining property on the fifth finger (little finger) side, when the glove is bent from an opened state to a gripping state, the finger covering part is bent with a twist at a gripping angle toward the first finger (thumb) side, wherein the stretchable members and the protective members are joined by at least one selected from sewing and bonding, wherein in the junction between the stretchable members and the protective members, a difference between a length of a junction allowance on the first finger (thumb) side of the stretchable member and a length of a junction allowance of the protective member corresponding to the junction allowance is greater than a difference between a length of a junction allowance on the fifth finger (little finger) side of the stretchable member and a length of a junction allowance of the protective member corresponding to the junction allowance, and wherein one or a plurality of narrowed portions are formed in the junction allowances on the first finger (thumb) side of the protective member, or in the junction allowance on the first finger (thumb) side and the junction allowance on the fifth finger (little finger) side of the same so that the length of the junction allowance on the first finger (thumb) side is greater than the length of the junction allowance of the fifth finger (little finger) side.

2. The glove according to claim 1, wherein the stretchable members are formed so that the stretchable member on the first finger (thumb) side is formed with a material having a greater stretching force as compared with the stretchable member on the fifth finger (little finger) side.

3. The glove according to claim 1, wherein the stretchable members are junctioned so that the stretchable member on the first finger (thumb) side is tensed more as compared with the stretchable member on the fifth finger (little finger) side.

4. The glove according to claim 1, wherein a stretching farce of the stretchable member on the first finger (thumb) side is 4 to 8% greater than that of a stretching force of the stretchable member on the fifth finger (little finger) side for the third finger (middle finger), 10 to 14% greater for the fourth finger (ring finger), and 15 to 19% greater for the fifth finger (little finger).

5. The glove according to claim 1, wherein the protective members are formed with at least one selected from natural leathers, synthetic leathers, and artificial leathers.

6. The glove according to claim 1, wherein the stretchable members are formed with at least one selected from knitted fabrics and woven fabrics.

7. The glove according to claim 6, wherein the stretchable members are formed with a two-way stretchable texture that is stretchable in a warp direction and a weft direction.

8. The glove according to claim 1, wherein the stretchable members are formed with at least one selected from natural leathers, synthetic leathers, and artificial leathers that are relatively more stretchable than the protective members.

9. The glove according to claim 1, wherein the stretching forces of the stretchable members are set such that an extension ratio of a 5 cm-wide piece thereof under a load of 4.9 N (500 gf) is in a range of 5 to 150% in at least one selected from the warp and weft directions.

10. The glove according to claim 1, wherein the stretchable members have weights per unit area in a range of 100 to 400 $g/m^2$.

11. The glove according to claim 1, wherein a width of the protective member is set equal to or smaller than a width of the finger and a width of the stretchable member is set equal to or smaller than a thickness of the finger so that the inner perimeter of each finger covering part is made substantially equal to the outer perimeter of the finger corresponding thereto.

12. The glove according to claim 1, wherein narrowed portions are formed in areas of the stretchable members and the protective members covering middle phalanxes and distal phalanxes of the third finger (middle finger), the fourth finger (ring finger), and the fifth finger (little finger), and recesses of the narrowed portions on the first finger (thumb) side for each finger are set greater than those on the fifth finger side.

13. The glove according to claim 12, wherein as compared with positions of the narrowed portions of the protective members on the posterior side of the glove fingers, positions of the narrowed portions of the protective members on the anterior side of the fingers are lowered by 0.5 to 3 mm.

14. The glove according to claim 1, wherein a twist angle when the glove is bent from an opened state to a gripping state is, in a direction toward the first finger (thumb) side, in a range of 2° to 4.5° for the third finger (middle finger), in a range of 5.5° to 8.5° for the fourth finger (ring finger), and in a rang of 9° to 12° for the fifth finger (little finger).

* * * * *